US009182170B2

(12) United States Patent
Rooks

(10) Patent No.: US 9,182,170 B2
(45) Date of Patent: Nov. 10, 2015

(54) OXYGEN VAPORIZATION METHOD AND SYSTEM

(75) Inventor: Raymond Edwin Rooks, Williamsville, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 1324 days.

(21) Appl. No.: 12/577,766

(22) Filed: Oct. 13, 2009

(65) Prior Publication Data

US 2011/0083470 A1 Apr. 14, 2011

(51) Int. Cl.

| | |
|---|---|
| ***F25J 3/00*** | (2006.01) |
| ***F25J 3/04*** | (2006.01) |
| ***F17C 5/00*** | (2006.01) |

(52) U.S. Cl.

CPC ..... *F25J 3/0409* (2013.01); *F17C 5/00* (2013.01); *F25J 3/04206* (2013.01); *F25J 3/04218* (2013.01); *F25J 3/04303* (2013.01); *F25J 3/04412* (2013.01); *F25J 3/04678* (2013.01); *F17C 2201/0109* (2013.01); *F17C 2201/056* (2013.01); *F17C 2205/0323* (2013.01); *F17C 2205/0341* (2013.01); *F17C 2221/011* (2013.01); *F17C 2221/014* (2013.01); *F17C 2221/016* (2013.01); *F17C 2223/0123* (2013.01); *F17C 2223/0161* (2013.01); *F17C 2223/0169* (2013.01); *F17C 2223/033* (2013.01); *F17C 2223/035* (2013.01); *F17C 2227/0135* (2013.01); *F17C 2227/0157* (2013.01); *F17C 2227/0185* (2013.01); *F17C 2227/0306* (2013.01); *F17C 2227/039* (2013.01); *F17C 2227/0339* (2013.01); *F17C 2265/01* (2013.01); *F17C 2270/05* (2013.01); *F25J 3/00* (2013.01); *F25J 2250/40* (2013.01); *F25J 2250/50* (2013.01)

(58) Field of Classification Search

CPC ..... B01D 2256/12; B01D 2256/10; B01D 2257/102; B01D 2257/104; B01D 53/54; B01D 71/58; B01D 2257/40

USPC ..... 62/640, 643, 644, 652, 654

See application file for complete search history.

(56) References Cited

U.S. PATENT DOCUMENTS

| | | | | |
|---|---|---|---|---|
| 4,817,394 | A | 4/1989 | Erickson | |
| 5,081,845 | A * | 1/1992 | Allam et al. | 62/646 |
| 5,098,456 | A | 3/1992 | Dray et al. | |

(Continued)

FOREIGN PATENT DOCUMENTS

| | | |
|---|---|---|
| WO | WO 88/09909 | 12/1988 |

*Primary Examiner* — Frantz Jules
*Assistant Examiner* — Webeshet Mengesha
(74) *Attorney, Agent, or Firm* — David M. Rosenblum; Robert J. Hampsch

(57) ABSTRACT

A method and system for producing an oxygen product stream in which sensible heat from a compressed air stream is indirectly exchanged with a vaporized pumped liquid oxygen stream in a main heat exchanger and latent heat is exchanged in an auxiliary heat exchanger connected to the main heat exchanger. The latent heat exchange produces subcooled liquid air that is fed into a low pressure column of the air separation plant and vaporization of the pumped liquid. Part of the subcooled liquid air can be withdrawn from the auxiliary heat exchanger at a higher temperature than the remainder of the subcooled liquid air. All or part of the subcooled liquid air can be further cooled within the main heat exchanger. As a result, low temperature, subcooled liquid air is produced that allows for an increased oxygen recovery and also, argon recovery if an argon column is present.

8 Claims, 2 Drawing Sheets

(56) References Cited

U.S. PATENT DOCUMENTS

| | | | | |
|---|---|---|---|---|
| 5,108,476 | A | | 4/1992 | Dray et al. |
| 5,365,741 | A | | 11/1994 | Roberts et al. |
| 5,386,692 | A | | 2/1995 | Laforce |
| 5,467,602 | A | | 11/1995 | Paolino et al. |
| 5,655,388 | A | | 8/1997 | Bonaquist et al. |
| 5,765,396 | A | * | 6/1998 | Bonaquist ..... 62/646 |
| 5,901,578 | A | | 5/1999 | Wong et al. |
| 6,430,962 | B2 | | 8/2002 | Miura et al. |
| 6,718,795 | B2 | | 4/2004 | Briglia |

* cited by examiner

OXYGEN VAPORIZATION METHOD AND SYSTEM

FIELD OF THE INVENTION

The present invention relates to an oxygen vaporization method and system for use in a cryogenic air separation plant in which an oxygen-rich liquid stream, withdrawn from a low pressure column, is pumped and then vaporized through indirect heat exchange with a compressed air stream resulting in liquefaction of the air stream. More particularly, the present invention relates to such a method and system in which latent heat is exchanged between the air stream and the pumped oxygen-rich liquid in an auxiliary heat exchanger.

BACKGROUND OF THE INVENTION

Oxygen is produced in air separation plants that employ a cryogenic rectification process to separate the air into its component parts. In such a plant, the air is compressed, purified and cooled within a main heat exchanger to a temperature suitable for its rectification within distillation column. Typically, such plants utilize an air separation unit having higher and low pressure distillation columns that are so designated in that the high pressure column operates at a higher pressure than the low pressure column. The compressed, purified and cooled air is introduced into the high pressure column to produce a crude liquid oxygen column bottoms, also known as kettle liquid. The crude liquid oxygen column bottoms is further refined in the low pressure column to create an oxygen-rich liquid column bottoms. The oxygen product can be taken as a liquid from such liquid column bottoms.

In a common type of air separation plant, the higher and low pressure columns are thermally linked by a condenser reboiler situated in the base of the low pressure column. A stream of nitrogen-rich vapor is withdrawn from the top of the high pressure column and is condensed within the condenser reboiler against vaporizing part of the oxygen-rich liquid collected in the bottom of the low pressure column. The condensed nitrogen-rich vapor is used to reflux both the higher and low pressure columns and may be taken in part as a product. Again, typically, nitrogen-rich vapor, produced as column overhead in the low pressure column, a stream of the oxygen-rich liquid column bottoms of the low pressure column and an impure nitrogen stream withdrawn from below the top region of the low pressure column are all introduced into the main heat exchanger to cool the air and to vaporize the oxygen-rich liquid and produce the oxygen product.

Where the oxygen product is desired at pressure, the oxygen-rich liquid produced in the low pressure column is pumped and then vaporized in main heat exchanger through indirect heat exchange with part of the air that has been compressed to a sufficiently high pressure for such purposes. The vaporization of the pumped liquid results in liquefaction of the compressed air to produce a subcooled liquid air stream. The liquid air stream after having been expanded to a suitable pressure of the low pressure column is introduced into the low pressure column. Part of such stream can also be suitably expanded and then introduced into the high pressure column. The introduction of the liquid air into the distillation columns, particularly the low pressure column, has the effect of increasing the recovery of the oxygen and also the argon where an argon column is connected to the low pressure column to produce an argon product.

The problem in conducting the vaporization of the pumped oxygen-rich liquid and the liquefaction of air entirely within the main heat exchanger is that a considerable length of the main heat exchanger is taken up in the transfer of latent heat for the vaporization of the oxygen-rich liquid and the liquefaction of the air. This leads to higher fabrication costs of the main heat exchanger. At the same time, since all passages within the main heat exchanger can become longer for such purposes, there are increased pressure losses within the main heat exchanger and therefore, increased power costs in the compression of the air. In order to overcome these problems, it is known to employ an auxiliary heat exchanger in which all latent heat transfer takes place between the pumped oxygen-rich liquid and the compressed air. Additionally, sensible liquid heat transfer also takes place within the auxiliary heat exchanger after liquefaction of the air and the oxygen-rich liquid prior to its vaporization. After vaporization of the oxygen-rich liquid, the resulting vapor is further warmed to ambient through indirect heat exchange of sensible heat with the compressed air entering the warm end of the main heat exchanger. While this arrangement incorporating the auxiliary heat exchanger results in a shorter heat exchanger, the degree to which the liquid air is subcooled is very limited given the amount of air that must be consumed in vaporizing the liquid oxygen and the amount of sensible heat that can be transferred from the oxygen-rich liquid to the liquid air within the auxiliary heat exchanger. Unfortunately, the degree to which the liquid air is subcooled will have an effect on oxygen and potentially argon recovery, if present, given that the colder the liquid air upon entry to the low pressure column, the greater degree to which oxygen and argon is driven down the column.

As will be discussed, the present invention provides a method and system for vaporizing a pumped liquid oxygen stream that utilizes an auxiliary heat exchanger in a manner in which the liquid air is introduced into the low pressure column and also the high pressure column at a lower temperature than that possible with the use of an auxiliary heat exchanger arrangement of the prior art.

SUMMARY OF THE INVENTION

In one aspect and in a specific embodiment, the present invention provides a method of vaporizing a pumped oxygen stream in a cryogenic air separation plant to form an oxygen-rich vapor product stream. In accordance with such method, sensible heat is indirectly exchanged from a compressed air stream formed within the cryogenic air separation plant stream to the pumped oxygen stream, after having been vaporized, such that the compressed air stream is partially cooled and the pumped oxygen stream is fully warmed to form the oxygen-rich vapor product stream. Latent heat is indirectly exchanged from the compressed air stream, after having been cooled, to the pumped oxygen stream such that the pumped oxygen stream is vaporized and the compressed air stream is liquefied to produce a liquid air stream.

At least part of the sensible heat is exchanged within a main heat exchanger so that the oxygen-rich vapor product stream is discharged from a warm end thereof. In this regard, the main heat exchanger is employed in the cryogenic air separation plant to cool air to a temperature suitable for its distillation within the distillation column system that produces an oxygen-rich liquid that is in turn pumped to form the pumped oxygen stream. At least part of the latent heat is exchanged in an auxiliary heat exchanger connected to the main heat exchanger at an intermediate location thereof. The liquid air stream is divided while within the auxiliary heat exchanger into a first subsidiary stream and a second subsidiary stream. The first subsidiary stream is discharged from the auxiliary heat exchanger such that the first subsidiary stream is subcooled and thereby forms a first subcooled stream and the second subsidiary stream is further subcooled and is discharged from the other end of the auxiliary heat exchanger as second subcooled liquid air stream. The first subcooled liquid air stream and the second subcooled liquid air stream are introduced into the distillation column system.

The removal of the first subcooled liquid air stream from the auxiliary heat exchanger allows the second subcooled liquid air stream to be further subcooled, resulting in such second subcooled liquid air stream be discharged from the cold end of the main heat exchanger at a lower temperature than that possible in prior art heat exchange arrangements incorporating auxiliary heat exchangers. The colder stream will have the effect of increasing the oxygen recovery and also, possibly the argon recovery if argon is to be recovered.

The first subcooled liquid air stream can be further cooled in a further set of heat exchange passages extending from the cold end of the main heat exchanger. The first subcooled liquid air stream is discharged from the cold end of the main heat exchanger prior to being introduced into the distillation column system.

The distillation column system can have a low pressure column in which the oxygen-rich liquid is produced as a column bottoms and a high pressure column operatively associated with the low pressure column in a heat transfer relationship. At least part of the first subcooled liquid air stream is introduced into the high pressure column and at least part of the second subcooled liquid air stream is introduced into the low pressure column.

In another specific embodiment of a method of the present invention, sensible heat is indirectly exchanged from a compressed air stream, formed within the cryogenic air separation plant, to the pumped oxygen stream after having been vaporized such that the compressed air stream is partially cooled and the pumped oxygen stream is warmed to form the oxygen-rich vapor product stream. Latent heat is indirectly exchanged from the compressed air stream after having been cooled to the pumped oxygen stream such that the pumped oxygen stream is vaporized and the compressed air stream is liquefied. Further sensible heat is indirectly exchanged from the compressed air stream, after having been liquefied, to the pumped oxygen stream such that liquid air within the compressed air stream subcools and a subcooled liquid air stream is formed from the liquid air. In such embodiment, at least part of the sensible heat and at least part of the further sensible heat are exchanged within a main heat exchanger configured such that the oxygen-rich vapor product stream is discharged from a warm end thereof and the subcooled liquid air stream is discharged from a cold end of the main heat exchanger located opposite to the warm end. At least part of the latent heat is exchanged in an auxiliary heat exchanger connected to the main heat exchanger at an intermediate location thereof. The subcooled liquid air stream is introduced into the distillation column system. In this regard, at least part of the subcooled liquid air stream can be introduced into at least the low pressure column of a distillation column system also having a high pressure column.

Since the further sensible heat is transferred from the liquid oxygen and other air streams within the main heat exchanger to the liquid air stream, the resulting liquid air stream is discharged from the cold end of the main heat exchanger at a lower temperature than that possible had such sensible heat been transferred solely within the auxiliary heat exchanger.

In yet another aspect, the present invention provides a heat exchange system in a cryogenic air separation plant to vaporize a pumped oxygen stream and thereby form an oxygen-rich vapor product stream. A main heat exchanger is provided that has a first set of heat exchange passages located within and extending from a warm end thereof. These heat exchange passages are configured to indirectly exchange heat from a compressed air stream, formed within the cryogenic air separation plant, to the pumped oxygen stream, after having at least been partially vaporized such that the compressed air stream is partially cooled, the pumped oxygen stream is fully warmed to form the oxygen-rich vapor product stream and the oxygen-rich vapor product stream is discharged from the warm end of the main heat exchanger. The main heat exchanger is integrated within the cryogen air separation plant to cool air to a temperature suitable for its rectification within a distillation column system that produces an oxygen-rich liquid that is in turn pumped to produce the pumped oxygen stream.

An auxiliary heat exchanger is provided that has a second set of heat exchange passages, at one end, in flow communication with the first set of heat exchange passages and configured such that latent heat is indirectly exchanged from the compressed air stream, after having been cooled in the first set of heat exchange passages, to the pumped oxygen stream. As a result, the pumped oxygen stream is at least partially vaporized and introduced into the first set of heat exchange passages and the compressed air stream is liquefied to produce a liquid air stream. The second set of heat exchange passages are configured such that the liquid air stream while within the auxiliary heat exchanger is divided into a first subsidiary stream and a second subsidiary stream, the first subsidiary stream is discharged from the auxiliary heat exchanger such that the first subsidiary stream is subcooled and thereby forms a first subcooled liquid air stream and the second subsidiary stream is further subcooled and is discharged from the other end of the second set of heat exchange passages as a second subcooled liquid air stream. The distillation column system in flow communication with the second set of heat exchange passages such that the first subcooled liquid air stream and the second subcooled liquid air stream are introduced into the distillation column system.

In another embodiment of the heat exchange system, the main heat exchanger also has a third set of heat exchange passages extending from a cold end thereof and configured to further cool the first subcooled liquid air stream and to discharge the first subcooled liquid air stream from the cold end of the main heat exchanger. The distillation column system is also in flow communication with the third set of heat exchange passages to receive the first subcooled liquid air stream.

The distillation column system can have a low pressure column in which the oxygen-rich liquid is produced as a column bottoms and a high pressure column operatively associated with the low pressure column in a heat transfer relationship. The low pressure column is in flow communication with the second set of heat exchange passages so that at least part of the second subcooled liquid air stream is introduced into the low pressure column. The high pressure column is in flow communication with the second set of heat exchange passages so that at least part of the first subcooled liquid air stream is introduced into the high pressure column. Where a third set of heat exchange passages are provided in the main heat exchanger, the high pressure column is in flow communication with the third set of heat exchange passages so that at least part of the first subcooled liquid air stream is introduced into the high pressure column.

In another embodiment of the heat exchange system, a main heat exchanger has a first set of heat exchange passages located within and extending from a warm end thereof and configured to indirectly exchange heat from a compressed air stream, formed within the cryogenic air separation plant, to the pumped oxygen stream, after having at least been partially vaporized. As a result, the compressed air stream is partially cooled, the pumped oxygen stream is fully warmed to form the oxygen-rich vapor product stream and the oxygen-rich vapor product stream is discharged from the warm end of the main heat exchanger. An auxiliary heat exchanger has a second set of heat exchange passages, at one end, in flow communication with the first set of heat exchange passages. These passages are configured to indirectly exchange latent heat from the compressed air stream, after having been cooled in the first set of heat exchange passages, to the pumped oxygen stream such that the pumped oxygen stream is at least partially vaporized and the compressed air stream is at least partially liquefied.

The main heat exchanger also has a third set of heat exchange passages extending from the cold end thereof and connected to the second set of heat exchange passages at the other end of the second set of heat exchange passages. The third set of heat exchange passages are configured to indirectly exchange further heat from the compressed air stream, after having been at least partially liquefied, to the pumped oxygen stream. As a result, the pumped oxygen stream warms and is introduced into the second set of heat exchange passages, liquid air within the compressed air stream subcools and a subcooled liquid air stream formed from the liquid air, after having been subcooled, is discharged from the cold end of the main heat exchanger. The distillation column system is in flow communication with the third set of heat exchange passages so that the subcooled liquid air stream is introduced into the distillation column system. In a distillation column system having a low pressure column, such column is in flow communication with the third set of heat exchange passages so that at least part of the subcooled liquid air stream is introduced into the low pressure column.

BRIEF DESCRIPTION OF THE DRAWINGS

While the specification concludes with claims distinctly pointing out the subject matter that Applicant regards as his invention, it is believed that the invention will be better understood when taken in connection with the accompanying drawings in which:

DETAILED DESCRIPTION

Figure 1:
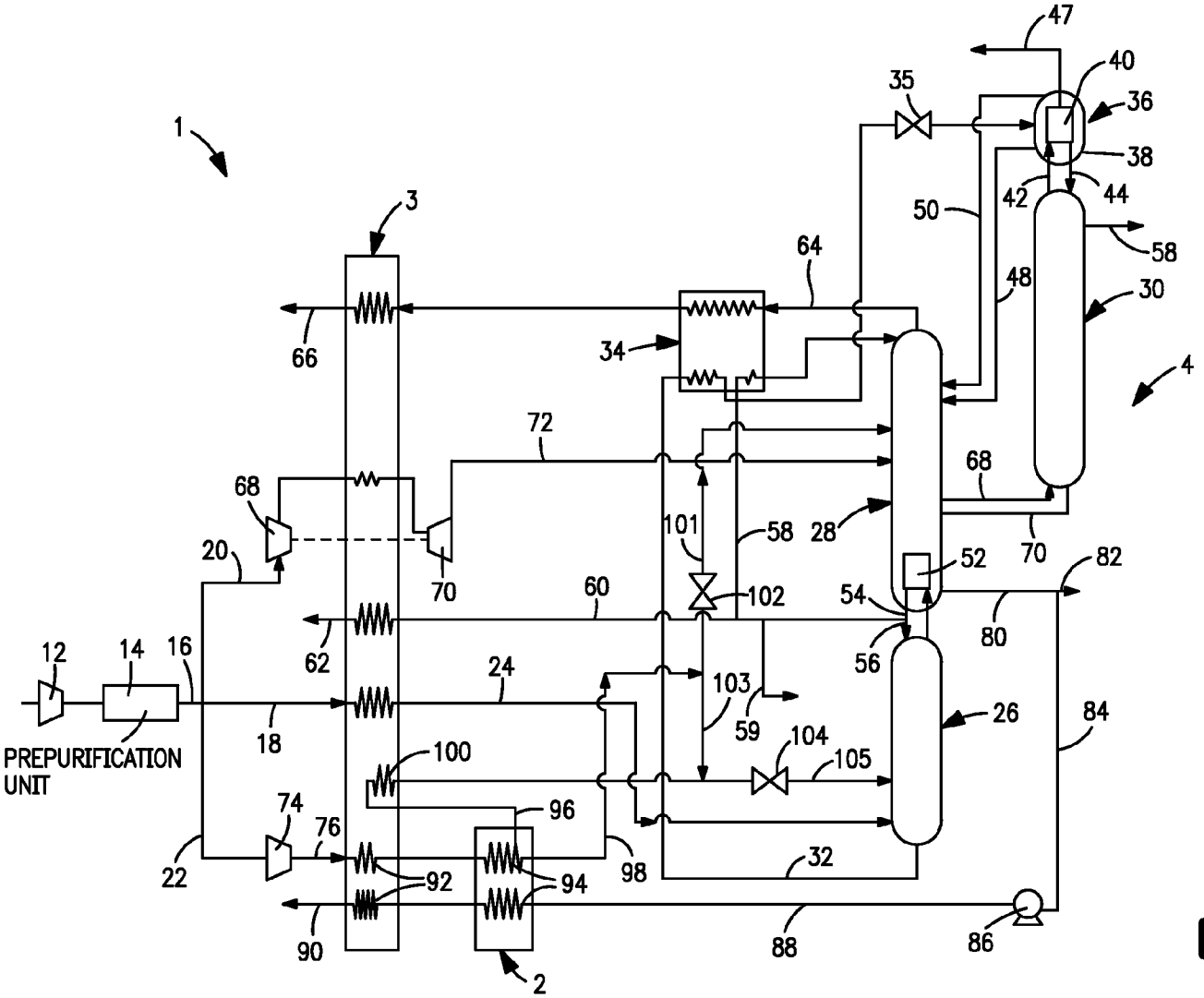
FIG. 1 is a schematic process flow diagram of an air separation plant incorporating a heat exchange system for carrying out a method in accordance with the present invention.

With reference to FIG. 1, an air separation plant 1 is illustrated that incorporates a heat exchange system in accordance with the present invention that, as will be discussed in more detail hereinafter, is an integration of an auxiliary heat exchanger 2 and a main heat exchanger 3 that together function to vaporize pressurized oxygen and liquefy compressed air that serves as part of the feed to a distillation column system 4. It is understood, however, that air separation plant 1 and the discussion thereof is for purposes of illustration as the present invention would have applicability to air separation plants employing a different arrangement of columns. In this regard, although the present invention is illustrated as having an argon column 30, to be discussed, the present invention is applicable to a column arrangement where argon is not recovered and hence, there exists no argon column.

In air separation plant 1, a feed air stream 10 is compressed by a main air compressor 12 and is then purified in a pre-purification unit 14 to produce a compressed and purified air stream 16. Main air compressor 12 may be an intercooled, integral gear compressor with condensate removal that is not shown. Pre-purification unit 14, as well known in the art, typically contains beds of alumina and/or molecular sieve operating in accordance with a temperature and/or pressure swing adsorption cycle in which moisture and other higher boiling impurities are adsorbed. As known in the art, such higher boiling impurities are typically, carbon dioxide, water vapor and hydrocarbons. While one bed is operating, another bed is regenerated. Other process could be used such as direct contact water cooling, refrigeration based chilling, direct contact with chilled water and phase separation.

Compressed and purified air stream 16 is divided into first, second and third air streams, 18, 20 and 22, respectively. First air stream 18 is cooled with main heat exchanger 3 to a temperature suitable for its rectification and is then introduced as a main air feed stream 24 into distillation column system 4. Typically, main heat exchanger 3 will be of brazed aluminum plate-fin construction and although one such unit is illustrated, it is understood that main heat exchanger 3 could be a series of parallel units that can in turn be subdivided into warm and cold end heat exchangers. As such, the term "main heat exchanger", as used herein and in the claims can be a single unit or in fact multiple units.

Specifically, main air feed stream 24 is introduced into a high pressure column 26 of the distillation column system 4 that is also provided with a low pressure column 28 and an argon column 30. Although not illustrated, each of the high pressure column 26, the low pressure column 28 and the argon column 30 is provided with mass transfer contacting elements such as structured packing, random packing or sieve trays or a combination of such elements to contact liquid and vapor phases of the mixture to be distilled in each of such columns in a manner known in the art.

The air introduced into the high pressure column 26 is rectified into a nitrogen-rich vapor column overhead and a crude liquid oxygen column bottoms, also known as kettle liquid. A crude liquid oxygen stream 32 is withdrawn from the bottom of high pressure column 26 and is subcooled within a subcooling unit 34 and thereafter, after pressure reduction in a valve 35, is introduced into a heat exchanger 36 associated with argon column 30 to condense reflux for such column and thereby initiate formation of a descending liquid phase within such column that would become evermore lean in argon and richer in oxygen. Heat exchanger 36 is provided with a shell 38 and a core 40 to indirectly exchange heat with the subcooled crude liquid oxygen stream 32 and an argon-rich vapor stream 42 produced as column overhead within argon column 30. As a result, the argon-rich vapor stream 42 is condensed into an argon reflux stream 44, part of which can be taken as an argon product stream 46. A purge gas stream 47 is discharged from the core 40 to prevent the accumulation of non-condensable gases, such as nitrogen, from accumulating within the heat exchanger. The subcooled crude liquid oxygen stream 32 is partially condensed within heat exchanger 36 and liquid phase and vapor phase streams 48 and 50 are introduced into low pressure column 28 for further refinement into an oxygen-rich liquid column bottoms and a nitrogen-rich vapor column overhead within such column.

High pressure column 26 is thermally linked to low pressure column 28 by a condenser reboiler 52 located in the base of the low pressure column 28. A nitrogen-rich vapor stream 5 is extracted from the top of the high pressure column 26 and is condensed in condenser reboiler 52 to produce a liquid nitrogen stream 54. Liquid nitrogen stream 54 is divided into reflux streams 56 and 58 that reflux the high pressure column 26 and the low pressure column 28, respectively. Reflux stream 58 is subcooled prior to being introduced as reflux to the low pressure column 28 within subcooling unit 34. Further, liquid nitrogen stream 54 can also be divided into a high pressure liquid nitrogen stream 59 and a nitrogen stream 60 that is vaporized within main heat exchanger 3 to form a high pressure nitrogen product vapor stream 62. A nitrogen-rich vapor stream 64 can also be withdrawn from the top of the low pressure column 28, partially warmed within subcooling unit 34 to also subcool crude liquid oxygen stream 32 and reflux stream 58, and then fully warmed to ambient within main heat exchanger 3 to produce a low pressure nitrogen product stream 66.

Turning again to the argon column 30, an argon-rich vapor stream 68 is withdrawn from the low pressure column 28 and introduced into argon column 30 where such stream is rectified to separate argon from the oxygen to produce the argon-rich column overhead, discussed above and an oxygen containing column bottoms. A stream 70 of the oxygen containing column bottoms is removed from the argon column 30 and introduced into the low pressure column 28. Argon column 30 can be designed with a limited number of stages to produce the argon product stream 46 as a crude product for further refinement to remove oxygen and nitrogen or can be provided with a sufficient number of stages to sufficiently separate the oxygen from the argon to produce the argon product stream 46 as the final product. Where there exists a more complete separation of the argon from the oxygen, typically, argon column 30 will be fabricated in two sections.

Second air stream 20 is further compressed in a booster compressor 68 and partially cooled within main heat exchanger 3. After compression, second air stream 20 is expanded in a turboexpander 70 to produce an exhaust stream 72 that is introduced into the low pressure column 28 for refrigeration purposes. As illustrated, turboexpander 70 is linked with booster compressor 68, either directly or by appropriate gearing. However, it is also possible that turboexpander 70 be connected to a generator to generate electricity that could be used on-site or routed to the grid.

In accordance with the present invention, the third air stream 22 is further compressed within a booster compressor and then introduced as a compressed air stream 76 into the main heat exchanger 3. An oxygen-rich liquid stream 80, composed of the oxygen-rich liquid column bottoms, discussed above, is withdrawn from the low pressure column 28. Oxygen-rich liquid stream 80 can be divided into a first subsidiary oxygen-rich stream 82 that can be taken as a liquid oxygen product and a second subsidiary oxygen-rich stream 84 that is pumped by a pump 86 to produce a pumped liquid oxygen stream 88. As can be appreciated, all of the oxygen-rich stream 80 could be taken in forming pumped liquid oxygen stream 88 or alternatively, part of pumped liquid oxygen stream 88 could be taken as a pressurized liquid product. As illustrated, however, pumped liquid oxygen stream 88 is vaporized within auxiliary heat exchanger 2 and then fully warmed within main heat exchanger 3 to produce an oxygen product stream 90. The heat exchange duty for such purposes is provided by compressed air stream 76 which is liquefied within auxiliary heat exchanger 2.

In order to effectuate the heat transfer, main heat exchanger 3 is provided with a first set of heat exchange passages 92 that extend from the warm end thereof and are configured to allow for indirect heat exchange between the compressed air stream 76 and the pumped liquid oxygen stream 88 after having been vaporized within auxiliary heat exchanger 2. The auxiliary heat exchanger is provided with a second set of heat exchange passages 94 that are in flow communication with the first set of heat exchange passages 92 within main heat exchanger 3 to indirectly exchange latent heat between the pumped liquid oxygen stream 88 and the compressed air stream 76 after having been cooled within main heat exchanger 3. As a result, the compressed air stream 76 liquefies and the pumped liquid oxygen stream 88 vaporizes.

The second set of heat exchange passages 94 are also designed so that the compressed air stream 76, after having been liquefied within the auxiliary heat exchanger 2 is divided at a location spaced from the cold end thereof such that a first subcooled liquid air stream 96 is withdrawn at a higher temperature than a second subcooled liquid air stream 98 that is fully cooled within the auxiliary heat exchanger 2. It is the withdrawal of the first subcooled liquid air stream 96 that allows the second subcooled liquid air stream 98 to be at a lower temperature and in fact a lower temperature than in prior art auxiliary heat exchangers discussed above and employed for similar purposes. The first subcooled liquid air stream 96 is then further cooled within the main heat exchanger 3 within a third set of passages 100 provided therein for such purposes and that extend to the cold end thereof and thereafter is introduced in its entirety introduced into the high pressure column 26. The second subcooled liquid air stream 98 is partly introduced into the low pressure column 28. In the illustrated embodiment, only part of the subcooled liquid air stream 98 is introduced into the low pressure column 28 as a first subsidiary subcooled liquid air stream 101. This is done by expanding first subsidiary subcooled liquid air stream 101 in an expansion valve 102 positioned upstream of the entry point of such stream in the low pressure column and then introducing such stream into a suitable location of the low pressure column 28. A second subsidiary subcooled liquid air stream 103 is combined with the first subcooled liquid air stream 96 to further cool the first subcooled liquid air stream 96. The resulting combined stream 105 is introduced into the high pressure column 26. This is done by expanding the combined stream 105 in an expansion valve 104 positioned upstream of the entry point of such stream into the high pressure column 26 and then introducing such stream into a suitable location of the high pressure column 26. As could be appreciated, all of the second subsidiary subcooled liquid air stream 98 could be introduced into the low pressure column 28. In any case, since the degree of subcooling attainable in accordance with the present invention is greater than that of the prior art, liquid production is increased and since more oxygen and argon is being driven down the low pressure column 28, argon production also increases.

Figure 2:
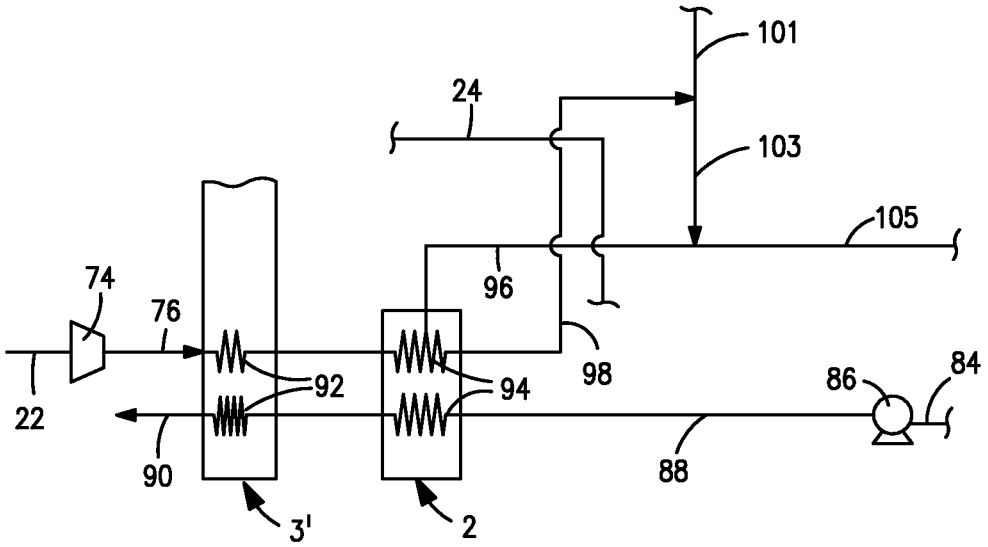
FIG. 2 is a fragmentary view of FIG. 1 illustrating an alternative embodiment of the heat exchange system shown in FIG. 1.

With reference to FIG. 2, a modification of the heat exchange system illustrated in FIG. 1 is shown in which there are no third set of heat exchange passages within the main heat exchanger 3' which otherwise is the same as the main heat exchanger 3 described above. In such embodiment, the first subcooled liquid air stream 96 is routed to the high pressure column 26 without further cooling within main heat exchanger 3. Again, as in the FIG. 1 embodiment, all of the first subcooled liquid air stream 96 could be introduced into the high pressure column 26 and all of the second subcooled liquid air stream 98 could be introduced into the low pressure column 28. The description of such modification of FIG. 1 is otherwise the same as the heat exchange system illustrated in FIG. 1.

Figure 3:
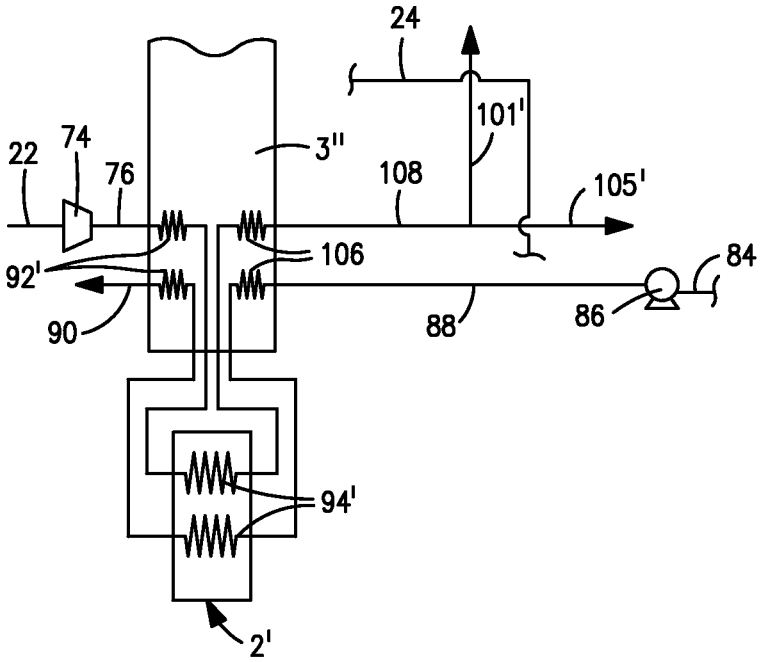
FIG. 3 is a fragmentary view of FIG. 1 illustrating yet another alternative embodiment of the heat exchange system shown in FIG. 1.

In the embodiments shown in FIGS. 2 and 3, the second subcooled liquid air stream 98 is in part introduced into the low pressure column 28 and also the high pressure column 26 by, for example, mixing such stream with the first subcooled liquid air stream 96. However, where additional reflux is needed in the low pressure column 28, part of the first subcooled liquid air stream 96 could be mixed with all of the second subcooled liquid air stream and the combined stream could be sent to the low pressure column 28 to increase the reflux, albeit at a slightly higher temperature.

With additional reference to FIG. 3, an embodiment of a heat exchange system in accordance with the present invention is shown in which a main heat exchanger 3" is provided with a first set of heat exchange passages 92' extending from a warm end thereof to exchange sensible heat from the compressed air stream 76 to the pumped liquid oxygen stream 88 after having been vaporized within auxiliary heat exchanger 2' to be discussed. The auxiliary heat exchanger 2' has a second set of passages 94, at one end, in flow communication with the first set of heat exchange passages 92' to vaporize the pumped liquid oxygen stream 88 and liquefy the compressed air stream 76. The main heat exchanger is also provided with a third set of heat exchange passages 106 located within an extending from the cold end of main heat exchanger 3'" to indirectly exchange further heat from the compressed air stream 76, after having been liquefied, to the pumped liquid oxygen stream 88 so that sensible heat is exchanged between such streams. It is to be pointed out that aside from the modification provided by the first set of heat exchange passages 92' and the third set of heat exchange passages 106, main heat exchanger 3'" is otherwise the same as main heat exchanger 3 shown and described above with reference to FIG. 1. The resulting liquid air within the second set of passages 106 subcools to form a subcooled liquid air stream 108. Subcooled liquid air stream 108 in its entirety can be introduced into the low pressure column 28 or split between the high pressure column 26 and the low pressure column 28 as streams 101' and 105'.

In any of the embodiments of the present invention, discussed, above, while it is preferable that all of the latent heat exchange occur within auxiliary heat exchanger 2, there could be partial vaporization and as such, partly vaporized liquid oxygen could be introduced into the first set of heat exchange passages within main heat exchanger 3, 3' or 3". In case of heat exchanger 3", partially liquefied air could be introduced into the third set of heat exchange passages 106. This is not preferred in that it would result in a heat exchanger design that is longer than that illustrated and discussed above.

It is to be noted that the subcooled liquid oxygen streams that are discharged from the auxiliary heat exchangers 2 and 2' described above with respect to the various embodiments illustrated herein can be further subcooled in a number of ways. For example, with reference to FIG. 1, the first subcooled liquid air stream 96 after passing through the main heat exchanger 3 and/or the second subcooled liquid air stream 98 could be routed through the subcooling unit 34. The heat exchange duty could be supplied by the cooled and reduced pressure kettle liquid withdrawn from the high pressure column 26 in the auxiliary heat exchanger 2.

The embodiments of the present invention illustrated in FIGS. 1, 2 and 3 were separately conducted and compared. The result of this is that while the embodiment of the heat exchange system of FIG. 3 had the lowest specific power, the embodiment of FIG. 1 had only a slightly higher specific power and with a slightly higher oxygen recovery. In any event, the FIG. 1 embodiment would also be slightly less complex than the embodiment of FIG. 3. The FIG. 2 embodiment has the lowest recovery. Details concerning the simulation of the FIG. 1 embodiment are set forth in the table below:

TABLE

| Stream | 18 | 24 | 20* | 72 | 76 | 76** | 98 | 88 | 88*** |
|---|---|---|---|---|---|---|---|---|---|
| Temperature (C.) | 12.8 | −168.4 | 38.6 | −165.5 | 38.6 | −153.4 | −176.1 | −179.0 | −156.2 |
| Pressure (kPa) | 614 | 593 | 1180 | 135 | 1673 | 1652 | 1660 | 688 | 664 |
| Flow (NCMH) | 215401 | 215401 | 42866 | 42866 | 98949 | 98949 | 59369 | 67481 | 67481 |
| Enthalpy (kJ/kgmole) | 8252 | 2713 | 8978 | 3053 | 8951 | 2696 | −2587 | −4034 | 3072 |
| Composition | | | | | | | | | |
| Nitrogen | 0.7811 | 0.7811 | 0.7811 | 0.7811 | 0.7811 | 0.7811 | 0.7811 | 0.0000 | 0.0000 |
| Argon | 0.0093 | 0.0093 | 0.0093 | 0.0093 | 0.0093 | 0.0093 | 0.0093 | 0.0015 | 0.0015 |
| Oxygen | 0.2095 | 0.2095 | 0.2095 | 0.2095 | 0.2095 | 0.2095 | 0.2095 | 0.9985 | 0.9985 |

*After compression within 68
**Between main heat exchanger 3 and auxiliary heat exchanger 2
***After auxiliary neat exchanger 2

| Stream | 90 | 64* | 66 | 32 | 96 | 96** | 46 | 62 |
|---|---|---|---|---|---|---|---|---|
| Temperature (C.) | 21.7 | −192.2 | 21.7 | −172.6 | −159.2 | −171.4 | −184.3 | 21.7 |
| Pressure (kPa) | 650 | 152 | 119 | 590 | 1653 | 1646 | 120 | 552 |
| Flow (NCMH) | 67481 | 89074 | 265499 | 126608 | 39579 | 39579 | 1250 | 17500 |
| Enthalpy (kJ/kgmole) | 8525 | −3181 | 8553 | −2694 | −1494 | −2311 | −4643 | 8538 |
| Composition | | | | | | | | |
| Nitrogen | 0.0000 | 0.999 | 0.978 | 0.594 | 0.7811 | 0.7811 | 6.06E−07 | 0.9991703 |
| Argon | 0.0015 | 8.247E−04 | 5.38E−03 | 0.017 | 0.0093 | 0.0093 | 0.999998 | 8.25E−04 |
| Oxygen | 0.9985 | 5.000E−06 | 1.71E−02 | 0.389 | 0.2095 | 0.2095 | 1.00E−06 | 5.00E−06 |

*After subcooling unit 34
**After main heat exchanger 3

While the present invention has been discussed in connection with preferred embodiments, as would occur to those skilled in the art, numerous changes and omission could be made without departing from the spirit and scope of the invention as set forth in the appended claims.

I claim:

1. A method of vaporizing a pumped oxygen stream in a cryogenic air separation plant to form an oxygen-rich vapor product stream, said method comprising:

indirectly exchanging sensible heat from a compressed air stream to the pumped oxygen stream, after having been vaporized such that the compressed air stream is partially cooled and the pumped oxygen stream is warmed to form the oxygen-rich vapor product stream;

indirectly exchanging latent heat from the compressed air stream, after having been partially cooled, to the pumped oxygen stream such that the pumped oxygen stream is vaporized and the compressed air stream is liquefied to produce a liquid air stream;

at least part of the sensible heat being exchanged within a main heat exchanger so that the warmed, oxygen-rich vapor product stream is discharged from a warm end thereof;

the main heat exchanger employed in the cryogenic air separation plant to cool air to a temperature suitable for its distillation within the distillation column system that produces an oxygen-rich liquid that is in turn pumped to form the pumped oxygen stream;

at least part of the latent heat being exchanged in an auxiliary heat exchanger connected to the main heat exchanger;

directing a portion of the compressed air stream from the main heat exchanger after having been partially cooled to the auxiliary heat exchanger and after having been liquefied within the auxiliary heat exchanger, dividing the portion of the liquefied air stream while within the auxiliary heat exchanger and into a first subsidiary stream and a second subsidiary stream;

discharging the first subsidiary stream from the auxiliary heat exchanger such that the first subsidiary stream is subcooled in the auxiliary heat exchanger and withdrawn from the auxiliary heat exchanger to form a first subcooled liquid air stream and the second subsidiary stream is subcooled in the auxiliary heat exchanger and discharged from the auxiliary heat exchanger as a second subcooled liquid air stream, wherein the first subcooled liquid air stream is withdrawn from the auxiliary heat exchanger at a higher temperature than the second subcooled liquid air stream; and introducing the first subcooled liquid air stream and the second subcooled liquid air stream into a distillation column system of the cryogenic air separation plant.

2. The method of claim 1, wherein the first subcooled liquid air stream is further cooled after withdrawal from the auxiliary heat exchanger but before introducing the first subcooled liquid air stream into the distillation column system in a set of heat exchange passages proximate the cold end of the main heat exchanger and the further cooled first subcooled liquid air stream is discharged from the cold end of the main heat exchanger prior to being introduced into the distillation column system.

3. The method of claim 1, wherein:

the distillation column system has a low pressure column in which the oxygen-rich liquid is produced as a column bottoms and a high pressure column operatively associated with the low pressure column in a heat transfer relationship;

at least part of the second subcooled liquid air stream is introduced into the low pressure column; and at least part of the first subcooled liquid air stream is introduced into the high pressure column.

4. The method of claim 2, wherein:

the distillation column system has a low pressure column in which the oxygen-rich liquid is produced as a column bottoms and a high pressure column operatively associated with the low pressure column in a heat transfer relationship;

at least part of the second subcooled liquid air stream is introduced into the low pressure column; and at least part of the first subcooled liquid air stream is introduced into the high pressure column.

5. A heat exchange system in a cryogenic air separation plant to vaporize a pumped oxygen stream and thereby form an oxygen-rich vapor product stream, said heat exchange system comprising:

a main heat exchanger having a first set of heat exchange passages located within and extending from a warm end thereof and configured to indirectly exchange heat from a compressed air stream to the pumped oxygen stream, after having at least been partially vaporized such that the compressed air stream is partially cooled, the pumped oxygen stream is warmed to form the oxygen-rich vapor product stream and the warmed oxygen-rich vapor product stream is discharged from the warm end of the main heat exchanger;

the main heat exchanger integrated within the cryogen air separation plant to cool air to a temperature suitable for its rectification within a distillation column system that produces an oxygen-rich liquid that is in turn pumped to produce the pumped oxygen stream;

an auxiliary heat exchanger having a second set of heat exchange passages, at one end, in flow communication with the first set of heat exchange passages and configured such that latent heat is indirectly exchanged from the compressed air stream, after having been partially cooled in the first set of heat exchange passages, to the pumped oxygen stream such that the pumped oxygen stream is at least partially vaporized and introduced into the first set of heat exchange passages and the compressed air stream is liquefied while within the auxiliary heat exchanger to produce a liquid air stream;

the second set of heat exchange passages of the auxiliary heat exchanger further configured to divide the liquid air stream while within the auxiliary heat exchanger into a first subsidiary stream and a second subsidiary stream;

wherein the first subsidiary stream is discharged from the second set of heat exchange passages in the auxiliary heat exchanger such that the first subsidiary stream is as a first subcooled liquid air stream and the second subsidiary stream is discharged from the other end of the second set of heat exchange passages as a second subcooled liquid air stream, wherein the first subcooled liquid air stream is withdrawn from the auxiliary heat exchanger at a higher temperature than the second subcooled liquid air stream; and wherein the distillation column system in flow communication with the second set of heat exchange passages such that the first subcooled liquid air stream and the second subcooled liquid air stream are introduced into the distillation column system.

6. The heat exchange system of claim 5, wherein the main heat exchanger further comprises a third set of heat exchange passages proximate a cold end thereof and configured to receive the first subcooled liquid air stream from the auxiliary heat exchanger and further cool the first subcooled liquid air stream and to discharge the further cooled first subcooled liquid air stream from the cold end of the main heat exchanger to the distillation column system.

7. The heat exchange system of claim 5, wherein:

the distillation column system has a low pressure column in which the oxygen-rich liquid is produced as a column bottoms and a high pressure column operatively associated with the low pressure column in a heat transfer relationship;

the low pressure column is in flow communication with the second set of heat exchange passages so that at least part of the second subcooled liquid air stream is introduced into the low pressure column; and the high pressure column is in flow communication with the second set of heat exchange passages so that at least part of the first subcooled liquid air stream is introduced into the high pressure column.

8. The heat exchange system of claim 6, wherein:

the distillation column system has a low pressure column in which the oxygen-rich liquid is produced as a column bottoms and a high pressure column operatively associated with the low pressure column in a heat transfer relationship;

the low pressure column is in flow communication with the second set of heat exchange passages so that at least part of the second subcooled liquid air stream is introduced into the low pressure column; and the high pressure column is in flow communication with the third set of heat exchange passages so that at least part of the first subcooled liquid air stream is introduced into the high pressure column.

* * * * *